US005442839A

United States Patent [19]

Miller

[11] Patent Number: 5,442,839

[45] Date of Patent: Aug. 22, 1995

[54] CONTROL CLIP FOR USE WITH A TOOTHPASTE TUBE

[76] Inventor: George C. Miller, 824 K Ave., Cayce, S.C. 29033

[21] Appl. No.: 207,283

[22] Filed: Mar. 7, 1994

[51] Int. Cl.[6] ..... A44B 21/00; B65D 37/00

[52] U.S. Cl. ..... 24/563; 24/531; 24/546; 222/103

[58] Field of Search ..... 24/563, 546, 545, 547, 24/453, 455, 541, 543, 531, 570; 222/103, 97

[56] References Cited

U.S. PATENT DOCUMENTS

| | | | |
|---|---|---|---|
| 424,016 | 3/1890 | Morgan | 24/543 |
| 2,390,314 | 12/1945 | Massey | 222/103 |
| 2,547,420 | 4/1951 | Sumner | 24/546 |
| 2,695,806 | 11/1954 | Balint | 24/563 |
| 3,247,558 | 4/1966 | Kaufman | 24/531 |
| 3,288,506 | 11/1966 | Cline | 24/563 |
| 3,289,892 | 12/1966 | Sencabaugh | 222/95 |
| 3,463,359 | 8/1969 | Piggush | 222/103 |
| 4,576,314 | 3/1986 | Elias et al. | 222/97 |
| 4,817,823 | 4/1989 | Sparr, Sr. | 222/103 |
| 4,947,524 | 8/1990 | Chang | 24/563 |
| 5,015,802 | 5/1991 | Chi | 24/295 |

FOREIGN PATENT DOCUMENTS

| | | | |
|---|---|---|---|
| 0807721 | 1/1959 | United Kingdom | 24/563 |

*Primary Examiner*—Victor N. Sakran
*Attorney, Agent, or Firm*—Michael A. Mann

[57] ABSTRACT

A clip for controlling a toothpaste tube when the end of the tube is folded into flattened coil. The clip is made of a resilient material and comprises an integrally attached front and back member. The front member terminates in an inwardly depending lip which, when engaging the edge of a fold made in the emptied part of the tube, prevents the coil from unfolding and the tube from slipping from the clip. The short lip near the open end of the clip holds the tube in the clip without having the clip clamp onto the tube. Thus the clip opening can be large enough to enable the tube to be easily inserted. The back member flares outwardly, allowing the contents of the tube to be easily expressed therefrom.

13 Claims, 1 Drawing Sheet

CONTROL CLIP FOR USE WITH A TOOTHPASTE TUBE

BACKGROUND OF THE INVENTION

1. Field of the Invention

The present invention relates generally to holders and clips for holding the, squeezed, bottom end of a partially-used tube, such as is used for toothpaste and creams, in a more compact configuration. More specifically, the present invention is a clip for controlling such a tube when it is in a coiled configuration.

2. Discussion of Background

Most toothpaste tubes are currently made of plastic. Heretofore, tubes were made of metal foil and were subject to tearing or being perforated, resulting in paste or cream issuing from hole formed by the tear or perforation. The unsealable hole enabled air to reach the paste or cream so that it would dry and cake. Metal foil tubes were thus unsatisfactory and plastic tubes gained rapid public acceptance.

However, in one respect, metal tubes were superior to plastic tubes: metal tubes did not have the "memory" that plastic tubes have. Memory is a characteristic of materials that is related to resilience. A material with memory will, after stress has been relieved, tend to restore itself to a configuration the material was in before the stress was applied. A plastic tube if coiled will tend to uncoil; a metal foil tube will much more readily remain coiled.

For reasons of economy, many people prefer to exhaust the supply of toothpaste in a tube before discarding it. Removing the toothpaste from a plastic tube is, to some extent, much easier than removing the toothpaste from a metal foil tube because the plastic tube can be subjected to squeezing without concern for perforations and tearing. But after squeezing the tube from the bottom end to the cap, the tube should be coiled to prevent the toothpaste from migrating away from the cap end of the tube. However, the tendency of a plastic tube to uncoil and straighten enables the toothpaste to migrate; a straightened tube encourages some people to squeeze the tube from the middle or top, near the cap, rather than from the bottom where they should if they want to force the toothpaste in the tube toward the cap. Finally, a partially spent toothpaste tube, with the marks of squeezing on it, does not look very neat.

There have been a number of attempts made to provide suitable clips and retaining clamps for toothpaste tubes but they are generally ineffective or overly complicated. Many of these hold the emptied end of the tube in a tight, round coil, clamped securely between the jaws of the clamp. The tightness of the jaws makes it difficult to put the tube into and remove the tube from these clamps. There remains a need for a toothpaste tube clip that will control the tendency of plastic tubes to uncoil and yet is convenient to use and inexpensive.

SUMMARY OF THE INVENTION

According to its major aspects and briefly stated, the present invention is a clip for use with a toothpaste or other, similar tube to hold a coil formed in the tube from its bottom end. The clip comprises a single flattened fold of a rigid, resilient material, open at one end where the tube is easily inserted. The clip is formed to have a back member that flares outward slightly, in a preferred embodiment, and an integral front member that terminates with an inwardly curving lip. If the toothpaste tube is coiled in a series of "folds" to form a flattened coil, rather than a cylindrical one, the coiled end of the tube can be inserted into the clip so that its lip will engage the forward edge of the coil. The natural resilience of the tube will cause it to uncoil against the tube, wedging itself between the front and back members, and the lip, in combination with the front and back members, prevents the tube from uncoiling or slipping out of the clip. The outwardly flaring back member enables the tube to be squeezed more easily just ahead of the clip.

The combination of the lip on the front member and the flattened front and back members of the clip is an important feature of the present invention. Because the toothpaste tube is coiled in a series of folds and not in a continuous spiral, "jelly-roll" style, it tends to uncoil by unfolding, book-like, rather than by increasing in diameter as a spiral would uncoil. Because of this characteristic, the unfolding flap will press against the front member and the forward edge of the flap will be behind the lip. The lip prevents the tube from sliding out of the clip; the front and back members prevent it from uncoiling. Meanwhile, the opening between the front and back members can be of a convenient size to allow the user to slip the tube into and out of the clip easily.

Another feature of the present invention is the outwardly flaring back member. The flare enables the user to squeeze the tube more easily at the point of the tube just outside the clip, urging the toothpaste remaining in the tube toward the cap and not away from it.

Other features and advantages will be apparent to those skilled in the art from a careful reading of the Detailed Description of A Preferred Embodiment, accompanied by the following drawings.

DETAILED DESCRIPTION OF A PREFERRED EMBODIMENT

Figure 1:
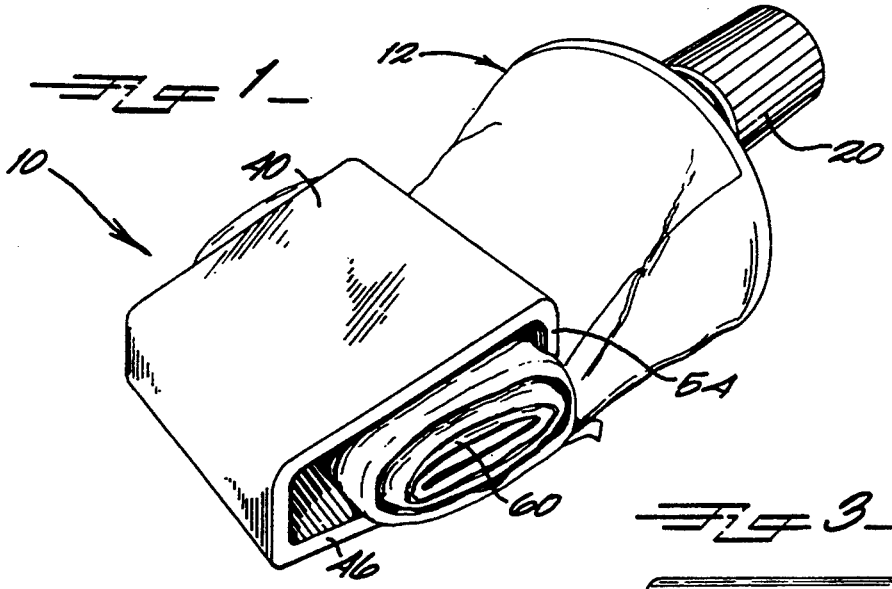
FIG. 1 is a perspective view of a device according to a preferred embodiment of the present invention.
Figure 3:
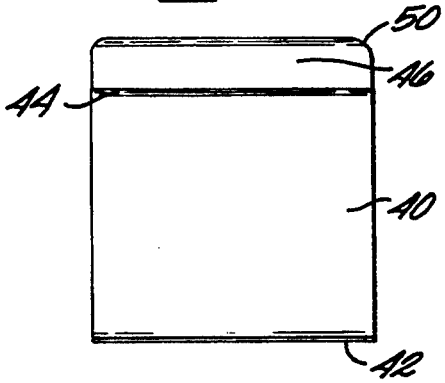
FIG. 3 is a top view of a device according to a preferred embodiment of the present invention.
Figure 2:
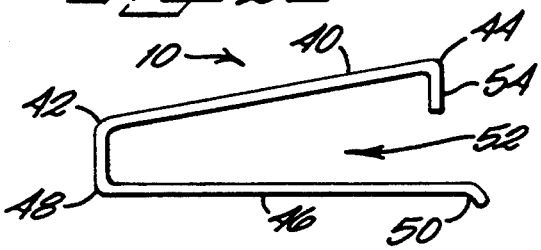
FIG. 2 is a side view of a device according to a preferred embodiment of the present invention.

Referring now to the Figures, the present device is a clip 10 for use with a tube 12 of toothpaste. Tube 12 is preferably made of plastic with a cap 20 on top end 22 and a flattened seam 24 on the bottom end 26. The purpose of clip is to hold a partially exhausted tube 12 in a coiled state. For purposes of illustration and description, device 10 is used in conjunction with a tube of toothpaste. However, it should be noted that clip 10 can be used in conjunction with plastic tubes that hold other substances as well; such as epoxy or adhesive tubes, and tubes containing medicinal ointments.

Toothpaste is expressed from tube 12 from bottom end 26 toward top end 22, causing tube 12 to have a thinned portion 30 and a thick portion 32. Thin portion 30 will be closer to bottom end 26.

Clip 10 has a front member 40, with a first end 42 and a second end 44, and a back member 46 with a first end 48 and a second end 50. First end 42 of front member 40 is preferably integrally joined to first end 48 of back member 46, leaving an opening 52 between second end 44 and second end 50. Preferably, front and back members 40, 46, diverge slightly from first ends 42, 48, to second ends 44, 50.

Second end 44 of front member 40 is curved toward back member 46 to form a lip 54. Second end 50 of back member flares outwardly, away from front member 40.

Figure 4:
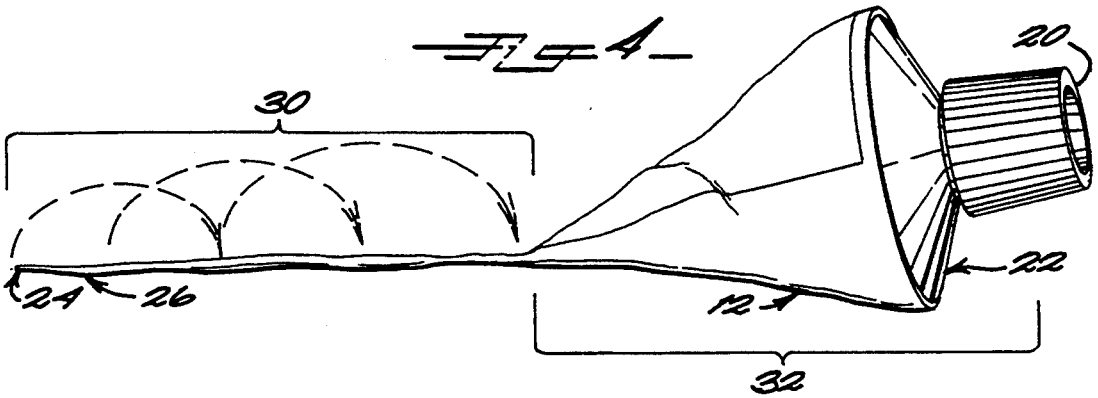
FIG. 4 is a side view of a tube of toothpaste showing the method of folding the tube for use in a device according to a preferred embodiment of the present invention.
Figure 5:
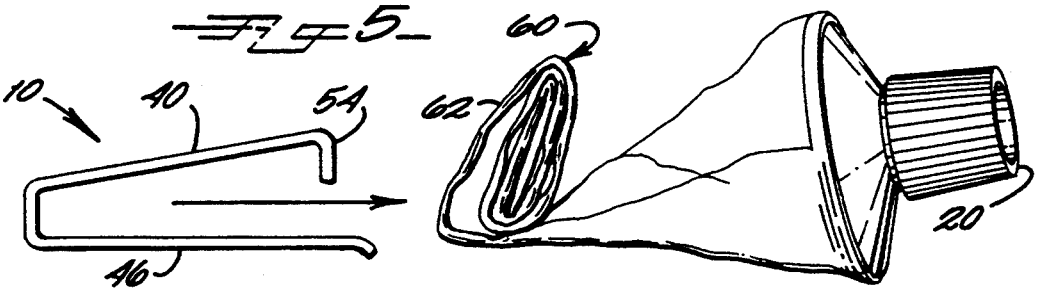
FIG. 5 illustrates the method of inserting the folded tube into the present device.

In this configuration, front and back members 40, 46, are seen to be essentially flattened. Tube 12 is coiled by forming a series of flaps or folds, as seen in FIG. 4, beginning from bottom end 26 and continuing toward top end 22, to form flattened coil 60. The natural resilience of a plastic tube 12 will cause flattened coil 60 to uncoil by opening booklike rather that by expanding in diameter the way a cylindrical coil uncoils. The forward end of the most recently formed flap 62 will tend move away from the body of tube 12. However, when in clip 10, flap 62 will be constrained by front member 40 from opening further. Moreover, lip 54 will constrain tube 12 from slipping out of clip 10 because it will engage flap 62. Thus, flap 62 is constrained from outward movement by front member 40, from forward movement by lip 54, from inward movement by the resilience of tube 12, and from rearward movement by the attachment of front and back members 40, 46, of clip 10. The user needs only to press on flap 62 far enough to slide it below lip 54 to remove tube from clip 10.

Clip 10 is preferably made of a rigid but resilient plastic, extruded and cut. However, clip 10 can also be made of metal or ceramic composite materials. It is best that it be resistant to degradation from water and the substance contained in the tube. Its front and back members 40, 46, are preferably also made of or coated with a material that may receive printing, such as advertising or logos, and so forth.

It will be apparent to those skilled in the art that many modifications and substitutions can be made to the preferred embodiment described above without departing from the spirit and scope of the present invention as recited in the appended claims.

What is claimed is:

1. A clip for use with a toothpaste tube, said toothpaste tube having a thinned portion and a thick portion, said thinned portion being folded in a series of flaps ending with a last flap, said clip comprising:

a flattened back member having a first end and an opposing second end; and a flattened front member having a first end and an opposing second end, said first end of said front member being attached to said first end of said back member, said front and said back members diverging, said back member and said front member defining a space therebetween, said front member having a lip formed on said front member along said second end and curved toward said back member to partially close said space, said lip being wide enough to substantially engage said last flap when said thinned portion of said toothpaste tube is inserted into said clip with said series of flaps toward said front member, said thick portion extending from said clip and said last flap behind said lip.

2. The clip as recited in claim 1, wherein said first end of said front member is integrally attached to said first end of said back member.

3. The clip as recited in claim 1, wherein said clip is made of plastic.

4. The clip as recited in claim 1, wherein said second end of said back member is flared outwardly.

5. The clip as recited in claim 1, wherein said first end of said front member is integrally attached to said first end of said back member.

6. The clip as recited in claim 1, wherein said clip is made of plastic.

7. The clip as recited in claim 1, wherein said second end of said back member is flared outwardly.

8. The clip as recited in claim 5, wherein said clip is made of plastic and wherein said first end of said front member is integrally attached to said first end of said back member.

9. The clip as recited in claim 1, wherein said clip is made of plastic and wherein said second end of said back member is flared outwardly.

10. The clip as recited in claim 1, wherein said first end of said front member is integrally attached to said first end of said back member, and wherein said second end of said back member is flared outwardly.

11. A clip for use with a tube, said tube having a thinned portion and a thick portion, said thinned portion being folded in a series of flaps ending with a last flap, said clip comprising:

a flattened back member having a first end and an opposing second end; and a flattened front member having a first end and an opposing second end, said first end of said front member being attached to said first end of said back member, said front and said back members diverging, said back member and said front member defining a space therebetween, said front member having a lip formed on said front member along said second end and curved toward said back member to partially close said space, said lip being wide enough to substantially engage said last flap when said thinned portion of said tube is inserted into said clip with said series of flaps toward said front member, said thick portion extending from said clip and said last flap behind said lip.

12. The clip as recited in claim 11, wherein said clip is made of plastic and wherein said first end of said front member is integrally attached to said first end of said back member.

13. The clip as recited in claim 11, wherein said first end of said front member is integrally attached to said first end of said back member, and wherein said second end of said back member is flared outwardly.

* * * * *